550-96.21 AU 251 EX
10/13/87 XR 4,698,987

United States Patent [19]

Brega

[11] Patent Number: 4,698,987

[45] Date of Patent: Oct. 13, 1987

[54] DEVICE FOR TRANSFERRING IN A KNITTING MACHINE

[75] Inventor: Angelo Brega, Varese, Italy

[73] Assignee: Mec-Mor S.p.A., Induno Olona VA, Italy

[21] Appl. No.: 858,800

[22] Filed: May 2, 1986

Related U.S. Application Data

[63] Continuation-in-part of Ser. No. 616,878, Jun. 4, 1984, Pat. No. 4,587,812.

[30] Foreign Application Priority Data

Jun. 15, 1983 [IT] Italy ..... 21643 A/83

[51] Int. Cl.[4] ..... D04B 15/00

[52] U.S. Cl. ..... 66/232; 350/96.21

[58] Field of Search ..... 66/218, 232; 350/96.2, 350/96.21

[56] References Cited

U.S. PATENT DOCUMENTS

| | | | |
|---|---|---|---|
| 3,317,735 | 5/1967 | Elsasser | 66/232 X |
| 3,510,667 | 5/1970 | Cleveland et al. | 350/96.2 X |
| 4,303,300 | 12/1981 | Pressiat et al. | 350/96.2 |
| 4,447,114 | 5/1984 | Koene | 350/96.2 |

FOREIGN PATENT DOCUMENTS

| | | | |
|---|---|---|---|
| 2800249 | 7/1978 | Fed. Rep. of Germany | 350/96.21 |
| 57-5005 | 1/1982 | Japan | 350/96.21 |
| 60-100110 | 6/1985 | Japan | 350/96.2 |

*Primary Examiner*—Wm. Carter Reynolds
*Attorney, Agent, or Firm*—Guido Modiano; Albert Josif

[57] ABSTRACT

The device is provided with electric signal emitting members associated with one machine portion, electric signal receiving members associated with another machine portion, a first and second optical fiber element respectively attached to a first and second stationary machine portion, a third and fourth optical fiber element attached to a rotating machine portion included between the first and second stationary machine portion. The ends of the first and second optical fiber element mutually face respective ends of the third and fourth optical fiber elements, the ends thereof laying coaxial with the axis of the rotating machine portion and the first and third optical fiber elements being autonomous from the second and fourth optical fiber elements for contemporaneously transmitting different signals having different frequencies from one of the machine portion to the other.

2 Claims, 3 Drawing Figures

DEVICE FOR TRANSFERRING IN A KNITTING MACHINE

This is a continuation-in-part of application Ser. No. 616,878, filed on June 4, 1984, now U.S. Pat. No. 4,587,812.

BACKGROUND OF THE INVENTION

This invention relates to a device for transferring control or drive signals or pulse between machine portions in mutual rotation relationship, particularly in a circular knitting machine. In order to transfer electric control pulses or signals between a stationary portion and rotating portion of a machine, e.g. between the stationary needle cylinder and rotary cam holding structure in a knitting machine, it has been proposed of using commutator and brush devices. The signals, which are effective to control elements of the machine such as solenoid valves of electropneumatic actuators for the needle selection slides, are transferred electrically by sliding contact between the commutator and its related brush.

These prior transfer or transmission devices operate substantially without problems with signals at relatively high voltage or current levels and at industrial range frequencies. However, they may give problems of space cluttering and weight where many components are to be controlled, one commutator and respective brush being generally required for each component to be controlled.

These devices are, above all, unsuitable for use with low level signals, e.g. on the order of some milliamperes and few volts, as are those employed for digital signal transmission in transferring control pulses for certain machine components. In this case, the sliding contact, whose resistance is highly variable, may introduce alterations in the typical electric parameters of the signals, which alterations may be deep ones with respect to the parameter involved and reflect in control errors. The very leads which conduct the signals may be a cause for mutual interference, especially with high frequency signals. Further, they may pick up noise interference which can induce an error in the signal itself.

Where the signal is to be also transferred with the machine at rest, then a different contact resistance occurs from that with the machine in operation, and this may lead to inaccuracies in the value of the signal transmitted in either cases.

Such problems are generally encountered not only with circular knitting machines but also with other machines including rotary portions, such as manufacturing machines in general, packaging machines of the rotating carousel type, machine tools having plural circularly distributed stations, and the like.

SUMMARY OF THE INVENTION

It is a main object of this invention to provide a device as indicated, which is free of the space, weight, interference, and error introduction problems outlined above, and can operate reliably with low control signals or pulses and also with signals transmitted at very high frequencies or sequence rates.

The device must be simple and economical, and affording the ability to transmit signals or pulses in either direction, i.e. from the stationary portion of the machine to the rotary one, and from the rotary portion to the stationary one.

These and other objects, such as will be apparent hereinafter, are accomplished by a device for transferring control or drive signals or pulses between machine portions in mutual rotation relationship, particularly in a circular knitting machine, comprising electric signal emitting member associated with one of said portions, electric signal receiving member associated with another of said portions, a first and second optical fiber element respectively attached to a first and second stationary machine portion, a third and fourth optical fiber element attached to a rotating machine portion included between said first and second stationary machine portion, ends of said first and second optical fiber element mutually facing to respective ends of said third and fourth optical fiber element, said ends laying coaxial with said rotation machine portion axis, said fist and third optical fiber elements being autonomous from said second and fourth optical fiber elements for contemporaneously transmitting different signals having different frequencies from one of said machine portion to the other.

In a device of this type, wherein the electric signal is converted into an optical signal and then re-converted into an electric signal, transmission takes place without sliding contact and, hence, without any problems from changing resistance at the commutator/brush devices. The optical signal, which is immune from interference and noise of electromagnetic nature affecting electric signals, is optically transferred respectively between the first and the third facing elements and the second and the fourth facing elements which, being disposed on the axis of the rotating portion, constantly remain facing each other as the rotating ends turn relatively to the stationary ends, thereby signals can be transmitted in the same conditions at any rotational speeds as well as with the machine at rest. The rotary elements can be easily centered by simply providing a bearing between the two stationary machine portions and the rotating portion, and by securing the rotary elements to the rotating portion of the bearings, as explained hereinafter. This arrangement of the optical fiber elements is specially compact and simple, and lends itself for transmission in either directions.

Advantageously, the transmitted signals may comprise a serial transmission of digital level logic signals which are transmitted from a stationary main electronic unit to a logic unit located on the rotating portion of the machine and vice-versa and adapted to sequentially control a set of actuators located on the rotating portion, such as electromagnets for programmed control of selection slides for the needle jacks in a circular knitting machine. However, the range of possible applications for the inventive device is not restricted to this particular case but encompasses a great many ones.

BRIEF DESCRIPTION OF THE DRAWINGS

Further details and advantages of the invention desoription of a device according thereto, given here by way of example and not of limitations with reference to the accompanying illustrative drawings of a preferred embodiment thereof, where.

DESCRIPTION OF THE PREFERRED EMBODIMENTS

The exemplary embodiment of the invention discussed herein below makes reference to a circular knitting machine as a particular application for the inventive device; however, it will be understood that the invention is not restricted to this particular application but may be useful in all those cases where control or drive signals or pulses are to be transferred between a stationary portion and rotary portion of a machine.

Figure 1:
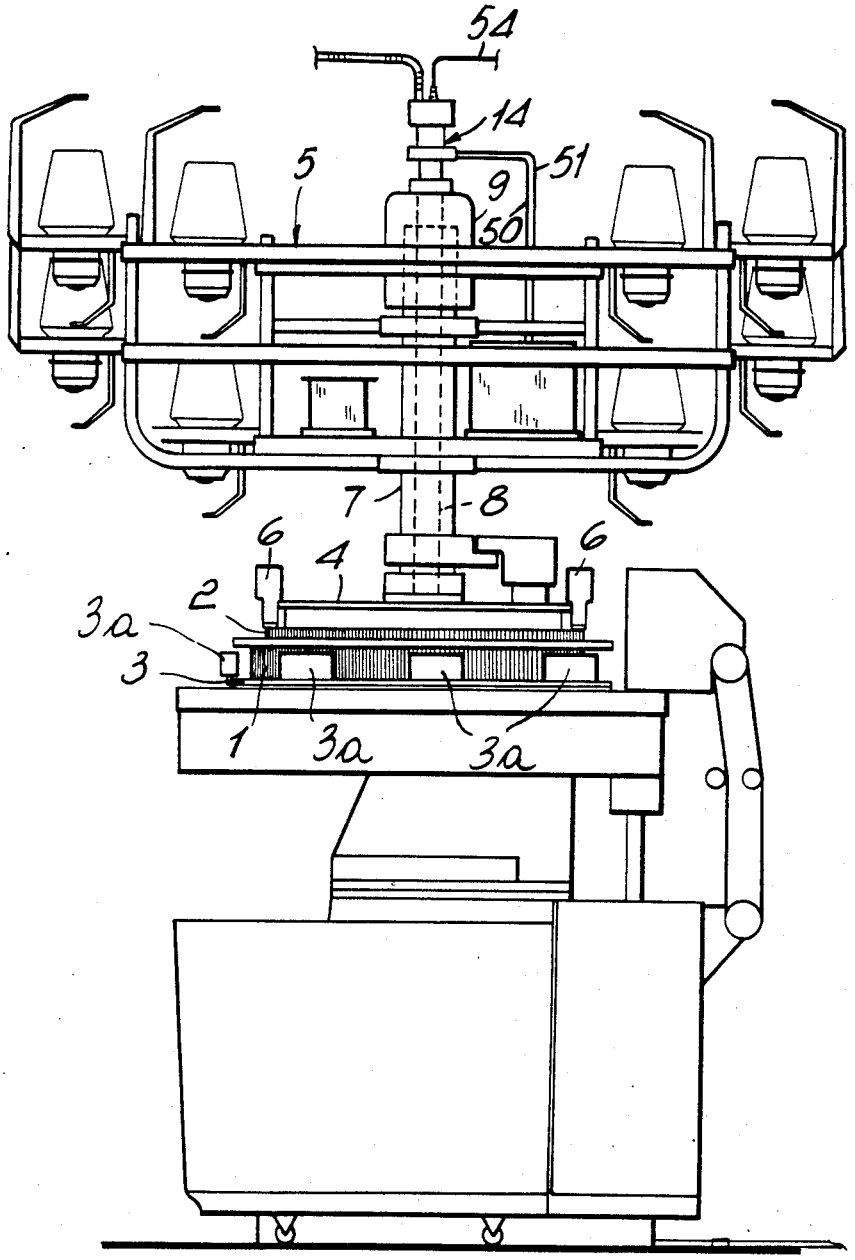
FIG. 1 is a schematic elevation view of a large diameter circular knitting machine incorporating a device according to the invention, by way of example.

The machine shown in FIG. 1 is of the large diameter type and comprises, in a manner known per se, a stationary cylinder 1 and dial 2, and a cam holding structure 3, 4 mounted rotatably. Together with the rotating structure 3, 4, the reel carrier 5 and related yarn feeds 6 are also arranged to rotate as are the needle selection devices.

The reel carrier 5 is attached to a hollow shaft 7 carried rotatably in the machine. A fixed shaft 8 extends through the interior of the hollow shaft 7 and is at least partly of hollow construction to accommodate electric leads for the power supply to and control of certain machine components. The fixed shaft 8 extends beyond the rotating shaft 7, which has a cap 9 rigidly attached thereto for accommodating any commutator/brush devices therein, not shown because foreign to this invention.

Figure 2:
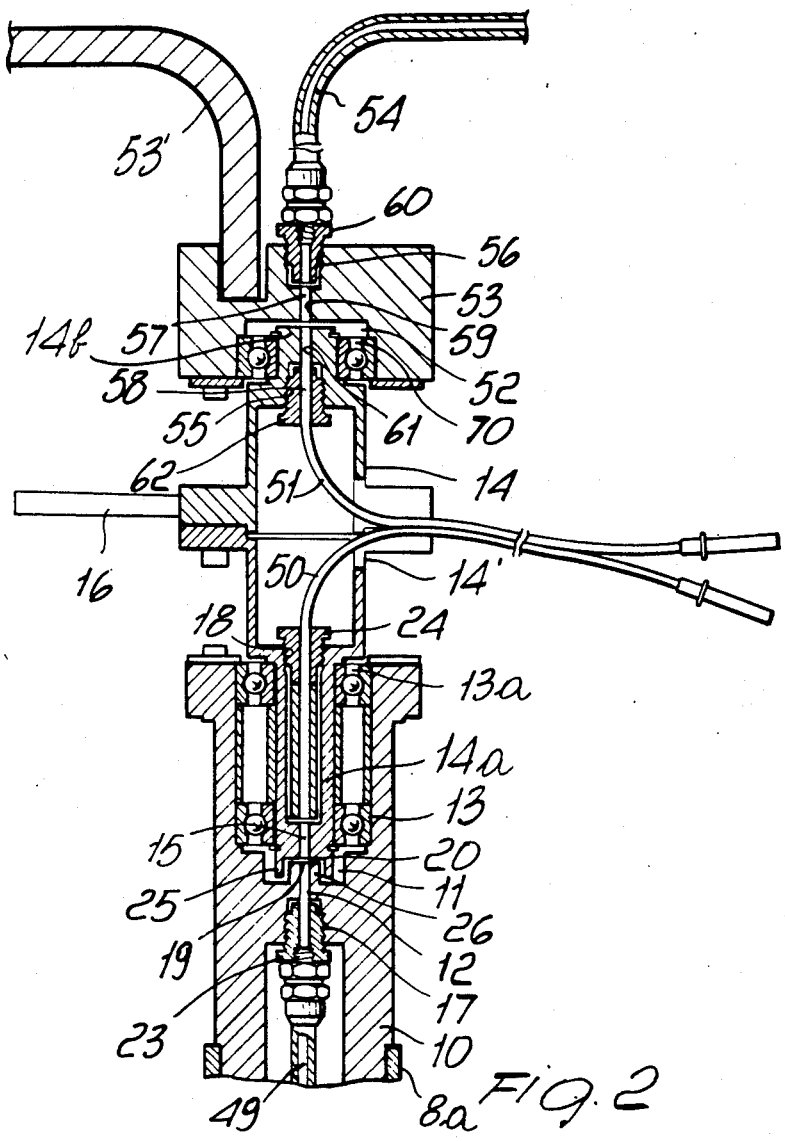
FIG. 2 is a sectional view of one portion of the inventive device, taken through the transition zone between the stationary portion and rotating portion of the machine.

The fixed shaft 8 is terminated with a hollow end 8*a*, best shown in FIG. 2. Attached to this hollow end 8*a*, and coaxially therewith, is a first supporting member 10 of substantially cylindrical shape, which has at the top a substantially cylindrical cavity 11 with an axis coincident with that of the shaft 8, and having a throughgoing axial bore 12 for accommodating the end of a first stationary optical fiber element 49. The cavity 11 houses two bearings 13-13*a*, the rotatable inner portions whereof being coaxially secured to a lower end portion of a composite positioning hollow member 14 in which is connected an end of a first rotatory optical fiber element 50. The upper end portion of the member 14, in which is connected an end of a second rotatory optical fiber element 51, is rotatably received by a bearing 70 in a substantially cylindrical cavity 52 of a second supporting member 53 of the second stationary machine portion. The supporting cover 53 is held in stationary position by an arm 53' of which only an end portion is shown, the other end portion thereof being fixed to the machine frame. With a top portion of the second cover 53 is connected the end of a second stationary optical fiber element 54. The positioning member 14 is also formed at the lower end thereof with a first throughgoing axial bore 15 and at the upper end thereof with a second axial throughgoing bore 61 coaxial therewith and with the axis of rotation of the member 14, i.e. of the rotating portion of the machine. It is further provided with an arm 16 made rigid with the reel carrier 5, thereby the positioning member 14 is driven rotatively by the rotating portion of the machine.

The positioning member 14 is a rotary supporting structure for the rotary cables. Such rotary supporting structure is in the form of a hollow cylindrical body having a lateral opening 14' for the passage therethrough of the rotating cables 50, 51. The cylindrical body 14 has journal formations 14*a* and 14*b* received in seats 11 and 52 respectively and bearingly supported by bearings 13, 13*a* and 70 respectively. The journal formations 14*a* and 14*b* have axial through openings 15, 61.

The first supporting cover 10, the upper and the lower ends of the member 14, and the second supporting cover 53 have each respective threaded sockets 17, 18, 55, 56 formed on opposite ends thereof. Attached to the first supporting cover 10 and member 14 are respective ends 19, 20 of the first stationary and first rotatory optical fiber elements 49, 50 comprising optical fiber cables of a type known per se. More specifically, the end 19 of the first stationary optical fiber element 49 is received in geometric fit relationship within the axial through bore 12 and stably retained therein by screwing a threaded bushing 23 into the threaded socket 17. The end 20 of the first rotatory optical fiber element 50 is likewise received to a form fit in the through bore 15 of the member 14 and locked therein by means of a threaded bushing 24 which is screwed into the threaded socket 18. Attached to the second supporting cover 53 and member 14 are respective ends 57, 58 of the second stationary and second rotatory optical fiber elements 54, 51 comprising optical fiber cables of a type known per se. The end 57 of the second stationary optical fiber element 54 is received in geometric fit relationship within the axial through bore 59 and stably retained therein by threading a threaded bushing 60 into the threaded socket 56. The end 58 of the second rotary optical fiber element 51 is likewise received to a form fit in the through bore 61 of the member 14 and locked therein by means of a threaded bushing 62 which is screwed into the threaded socket 55.

Thus, the ends of the optical fiber elements 49, 50, 51 e 54 are caused to face each other axially at the axis of the machine rotating portion, the end of the firstrotating optical fiber element 50 being supported by the shown structure on the stationary portion through the two bearings 13 and 13*a*, the bearing 70 cooperating in guiding the rotatory movement of the composite positioning hollow member 14.

From the foregoing, it will be understood that the optical fiber cables 50, 51 constitute a rotary cable structure whereas the optical fiber cables 49, 54 constitute a stationary cable structure, and that the stationary optical fiber ends 19 and 57 face each with a gap the rotary cable ends 20 and 58, respectively.

It will be further understood that the coaxial spaced apart supporting or holding member 10, 53 and the rotatory positioning or holding member or structure 14, together with the shown component parts thereof constitute a connector device for two pairs of optical fiber cables including stationary and rotatory optical fiber cables.

Advantageously, the first supporting cover 10 is provided with an axial, substantially cylindrical lug 26 penetrating the cavity 11, and the member 14 has an axial annular ridge 25 dimensioned to encircle the lug 26 with some play.

This arrangement has the advantage of preventing dirt from entering the gap between the two ends 19, 20 of the elements 49, 50.

The optical fiber elements 49 and 51 are connected to electric control or drive signal or pulse emitting means with the interposition of an electro-optical transducer, as shortly explained hereinafter. The second and third optical fiber elements 54, 50 are connected to electric control or drive signal or pulse receiver means through a respective opto-electric transducer, as shortly explained hereinafter.

The arrangement of the optical fiber elements with respective facing ends provides optical fiber transmission means and enables continuous or intermittent transfer of signals between the machine rotating and stationary portions, in identical conditions, whether the machine is being operated or at rest. The rotating ends 15, 58 in fact, never changes its position relatively to the stationary ends 19, 57.

Figure 3:
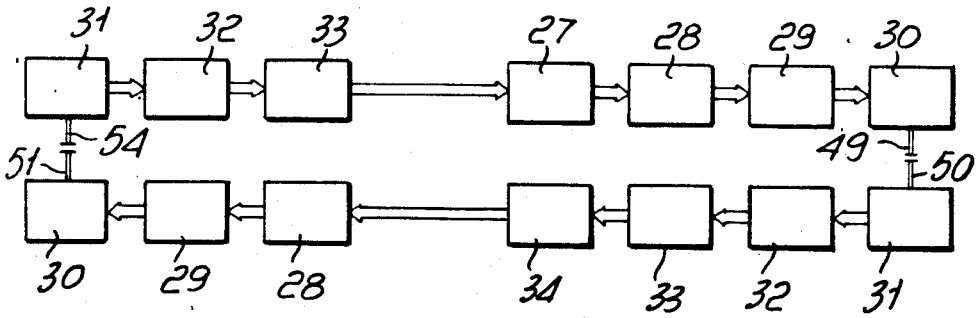
FIG. 3 is a block diagram of an exemplary embodiment of the device of this invention.

An exemplary application of the device just described for controlling the actuators of a circular knitting machine is represented in block diagram form in FIG. 3. From a microprocessor main control unit 27, the control signals in digital form are transmitted to a first signal encoder 28, whence the now coded signals are supplied, via a first adapter 29, to a first opto-emitter element 30. This is located at the opposite end of the optical fiber element 49 from the end 19, and converts the signals into an optical form to then pass them to the optical fiber element 49. The members 27, 28, 29 and 30 are all located on the machine stationary portion or associated therewith.

Through the rotary optical coupling formed at the ends 19, 20 of the elements 49, 50, the optical signals are transmitted to the rotating cable element 50 and then reconverted to electric signals through a first optoreceiver element 31. Then they reach, through a first adapter 32, a first decoder 33 and then a control or drive interlocked unit 34 of the microprocessor type. The latter would be secured, for example, to the reel carrier 5, and sequentially control, through power amplifiers, machine actuators 3*a* located on the rotating portion, such as electromagnets driving selection slides for the needle jacks, or electromagnets driving movable cams. The members 31, 32, 33 and 34 are all located on the machine rotating portion.

The device also operates in the opposite direction, from the drive interlocked unit 34 of the microprocessor type the signals in digital form are transmitted to a signal encoder, whence the now coded signals are supplied, via a second adapter, to a second opto-emitter element. This is located at the opposite end of the fourth optical fiber element 51, and converts the signals into an optical form to then pass them to the second optical fiber element 54.

Through the rotary optical coupling formed at the ends 57, 58 of the elements 54, 51 the optical signals are transmitted to the second stationary portion and then reconverted to electric signals through a second optoreceiver element. Then they reach, through a second adapter, a decoder 33 and then the microprocessor main control unit 27.

It will be appreciated from the foregoing that a device according to the invention enables electric signals or pulses having different frequencies to be transferred between a rotating portion and stationary portion of a machine and vice-versa in an extremely simple, economical, and compact way, using means of minimal weight even where a relatively high number of actuators are to be controlled sequentially.

Reference has been made to signals of a digital nature, but it may be appreciated that the signals could have different natures and any patterns.

The invention disclosed hereinabove is susceptible to many modifications and variations without departing from the scope of the instant inventive idea.

I claim:

1. In a circular knitting machine having at least one stationary machine portion and at least another rotatory machine portion defining an axis of rotation thereof and first signal emitting and/or receiving means for controlling actuators of the knitting machine, said first means located on said stationary machine portion, and second signal emitting and/or receiving means for controlling acutators of the knitting machine, said second means located on said rotatory machine portion, optical fiber transmitting means between said first and said second signal emitting and/or receiving means, comprising optical fiber connector device for two pairs of optical fiber cables of which a first pair includes a first stationary optical fiber cable structure supported on said stationary machine portion and a first rotatory optical fiber cable structure supported on said rotatory machine portion and a second pair includes a second stationary optical fiber cable structure supported on said stationary machine portion and a second rotatory optical fiber cable structure, said first stationary optical fiber cable structure having a first stationary terminal end connection portion with a first stationary end face thereof, said first rotatary optical cable structure having a first rotatory terminal end connection portion with a first rotatory end face thereof, said second stationary optical fiber cable structure having a second stationary terminal end connection portion with a second stationary end face thereof, said second rotatory optical fiber cable structure having a second rotatory terminal end connection portion with a second rotatory end face thereof, said rotary optical fiber connector device comprising, a first stationary supporting structure supported on said stationary machine portion and having first stationary holding means coaxial with said axis of rotation for fixedly holding said first stationary terminal end connection portion in a position coaxial with said axis of rotation, a second stationary supporting structure supported on said stationary machine portion and having second stationary holding means coaxial with said axis of rotation at a distance from said first holding means thereby to leave a free space therebetween and for fixedly holding said second stationary terminal end connection portion in a position coaxial with said axis of rotation and facing said free space, a rotatory supporting structure within said free space between said first and said second stationary supporting structure, said rotatory supporting structure being supported on said rotatory machine portion for rotation about said axis of rotation, said rotatory supporting structure having first rotatory holding means facing said first stationary holding means and coaxial with said axis of rotation for holding in rigid rotatory relation therewith said first rotatory terminal end connection portion in a position coaxial with said axis of rotation and clearingly facing with said first rotatory end face thereof said first stationary end face of said first stationary terminal end connection portion to form a gap therebetween, second rotatory holding means on said rotatory supporting structure facing said second stationary holding means and coaxial with said axis of rotation for holding in rigid rotatory relation therewith said second rotatory terminal end connection portion in a position coaxial with said axis of rotation to clearingly face with said second rotatory end face thereof said second stationary end face of said second stationary terminal end connection portion to form a second gap therebetween.

2. A connector device according to claim 1, wherein said rotatory supporting structure comprises a hollow cylindrical body having coaxial hollow journal formations on opposite ends thereof coaxial with said axis of rotation, at least one lateral opening for the passage therethrough of said first and second rotatory cable structures and opposite coaxial end openings coaxial with said axis of rotation for the passage therethrough of said first and second rotatory terminal end connection portions and wherein said first and second stationary supporting structure have seat formations for receiving therein said journal formations of said rotary supporting structure and bearing means within said seats for journalling therein said journal formations.

* * * * *